United States Patent [19]

Luyckx

[11] 4,142,887

[45] Mar. 6, 1979

[54] STEEL LADLE DESULFURIZATION COMPOSITIONS AND METHODS OF STEEL DESULFURIZATION

[75] Inventor: Leon Luyckx, New Castle, Pa.

[73] Assignee: Reactive Metals & Alloys Corporation, West Pittsburgh, Pa.

[21] Appl. No.: 879,610

[22] Filed: Feb. 21, 1978

[51] Int. Cl.[2] ..... C21C 7/02

[52] U.S. Cl. ..... 75/58; 75/53

[58] Field of Search ..... 75/53, 58

[56] References Cited

U.S. PATENT DOCUMENTS 4,014,685 3/1977 Jones ..... 75/58

*Primary Examiner*—P. D. Rosenberg

*Attorney, Agent, or Firm*—Buell, Blenko & Ziesenheim

[57] ABSTRACT

A ladle desulfurization composition and method are provided in which molten steel to be desulfurized is mixed with a mixture of particulate metallic aluminum, fluorspar and lime to deoxidize and desulfurize the metal and form a fluxed slag.

8 Claims, No Drawings

STEEL LADLE DESULFURIZATION COMPOSITIONS AND METHODS OF STEEL DESULFURIZATION

This invention relates to steel ladle desulfurization compositions and methods of steel desulfurization and particularly to compositions suitable for ladle desulfurization of semi-killed and fully killed type steels, particularly those of low carbon content.

The problem of steel desulfurization is almost as old as steel-making itself. Over the last decade, the discovery of the particular criticality of control over sulfide inclusions in steels for high strength light weight automotive parts, offshore oil and gas drilling platforms, artic line pipes, ship plates and improved impact properties in general, has increased the pressure upon steelmakers to minimize sulfur contents in an ever increasing percentage of steel products. While control over sulfide inclusions can also be achieved with such additives as rare earth metals (U.S. Pat. No. 3,666,452, zirconium; U.S. Pat. No. 4,052,202, titanium, calcium and magnesium) considerations of economy and conservation dictate to work concomitantly on lowering the sulfur content of the steel by lower cost artificial slags.

In certain types of semi-killed steels, simultaneous control of oxide and sulfide inclusions can be achieved without the need for extra-low sulfur contents (U.S. Pat. No. 3,951,645). This is, however, the exception.

Today, the most economical approach to low sulfur steels in large integrated steel plants is a hot metal desulfurization station between blast furnace and steel plant. Many patents and publications cover that area. Other sources of sulfur after hot metal desulfurization enter into play, however, mostly the scrap charge (open hearth, electric and basic oxygen furnaces) and the fuels (open hearth) which may, in many cases, cancel the effect of the hot metal desulfurization program. Some modern steel applications require such low sulfur residuals (0.015 or 0.010 or 0.005% max.) that the only sure way to achieve these specifications is to work both on hot metal and steel in a two-step desulfurization program, thereby rendering steel ladle desulfurization an increasingly necessary proposition.

Over the past several years, steel ladle desulfurizing mixes have been proposed in response to this need and met with considerable commercial success and popularity. However, it was quickly recognized that the technique was not generally applicable to all semi-killed steels and not at all to rimming steels. In addition, amplitude and consistency of desulfurization was inversely proportional to the tap carbon content of the steel. In practice, these prior art desulfurizing mixes would not work well on extra-low carbon steels tapping between 0.02 and 0.10% carbon. Finally, the soda ash content of these prior art mixes produces an inordinate amount of smoke and could be objectionable to health and ladle refractory life.

The present invention provides a composition which will specifically satisfy most of these shortcomings of the prior art, i.e., it will permit a high degree of desulfurization consistently for both semi-killed and killed type steels and for extra low and low carbon steels with a minimum of emissions, zero toxicity, minimum ladle refractory erosion and at a cost which is commercially acceptable. The only remaining shortcoming is the impossibility of treating rimming steels.

I provide a desulfurization composition or mix for ladle desulfurization for addition to a ladle before or during tapping or for injection after tapping based upon sufficient lime, fluorspar and metallic aluminum to provide deoxidation of the slag and $Al_2O_3$ and heat for CaO fluxing leading to consistent desulfurization of the steel. Such a composition should be broadly made up of about 50% to about 80% burnt lime, about 5% to 35% metallic aluminum and about 10% to about 40% fluorspar, all by weight. Small amounts of other ingredients can be tolerated, except that alkali compounds are preferably absent because of the health hazard at steel making temperatures.

A preferred narrower general use composition contains about 60% to about 75% pulverized burnt lime, about 5% to about 15% atomized metallic aluminum and about 10% to about 25% fine mesh acid or ceramic grade fluorspar.

Preferably, I tailor the composition of this invention, particularly the aluminum content, to the type of steel to be treated in order to obtain maximum economy and efficiency.

In extra low carbon steels (C 0.03 to 0.08%) which are highly oxidized at tap the metallic aluminum content is the highest, normally 15 weight %, and concurrently the $CaF_2$ requirement is the lowest (15%). Mixes with up to 35% metallic aluminum are provided for ultra-low tap carbons of 0.01 to 0.025% such as for silicon steel desulfurization requirements.

A middle-of-the-road mix uses 10% Al and 20% $CaF_2$, balance lime for tap carbon ranging from 0.04 to 0.15% and is the composition most generally used.

Finally, a third mix for limited oxygen contents at tap only contains 5% Al, 25% $CaF_2$ and the balance lime (70%) and successfully competes price-wise with other mixes on the market for use with killed steels and many semi-killed steels.

Four essential conditions govern good desulfurization of molten iron or steel by a slag phase:

1. High basicity or V ratio $CaO/SiO_2$
2. High temperature
3. Low oxygen potential (low FeO and MnO)
4. High slag metal interface (implies high fluidity and strong agitation)

Molten steel has the automatic advantage over hot metal of much higher temperatures, Condition #2, and steel tapping from a furnace provides the ideal opportunity for Condition #4, strong agitation if the mix can be quickly fluxed. Unfortunately, Condition #3 is a major disadvantage of steel as compared to hot metal and the main reason why competing fluxes do not work on low carbon steels.

The mix of my invention responds ideally to the requirements of Condition #1, #3 and 190 4.

Condition #1: Zero $SiO_2$ except from impurities. Major CaO content from lime ingredients in the mix.

Condition #2: Satisfied by high tapping temperatures of low carbon steels.

Condition #3: High metallic aluminum content in the mix to counteract the high dissolved oxygen content in the steel, and the slag carried over.

The reactions $$3FeO+2Al \rightarrow Al_2O_3+3Fe$$

$$3MnO+2Al \rightarrow Al_2O_3+3Mn$$

which consume the metallic aluminum component of the mix with the high amount of FeO and MnO contained in low carbon steels at tap serve a triple purpose: First, it conducts to a low oxygen potential, by eliminating FeO and MnO. This satisfies Condition #3. Second, the reaction product, $Al_2O_3$, provides a self-fluxing action, with CaO.

Alumina being a neutral oxide does not affect the V ratio (Condition #1) and the $Al_2O_3$ - CaO phase diagram shows that it is an ideal high temperature fluxing agent for CaO. Third, the above reactions generate a considerable amount of heat which accelerates the fluxing operation, minimizes sensible heat transfer from the molten steel to the mix to be fluxed and, uniquely, appears to help collapse some of the smoke in the mid-air by melting the suspended particles.

Condition #4: The main flux for CaO is $Al_2O_3$ provided by the reaction described here above in Condition #3. The quick fluxing action requires help under the form of $CaF_2$, ceramic or acid grade fluorspar, because the metallic aluminum content permissible is limited by steel chemistry and pricing considerations. Soda ash, $Na_2CO_3$, is specifically absent from the mix because of its decomposition at steelmaking temperatures into $Na_2O$ and $CO_2$ introducing health hazards, bad smoking condition, bad smell and ladle refractory erosion.

Particle size of the ingredients of the invention plays a second essential part as it produces quick fluxing action. The three ingredients, burnt lime, atomized aluminum and ceramic or acid grade fluorspar are preferably all less than 35 mesh in size with a large fraction between 100 and 200 mesh. While the prior art has been based upon the belief that this is a major risk for smoke generation, I have found this fine to ultra fine particle size in my particular composition results in much faster smoke abatement after the first impact of liquid steel on the desulfurizer in the bottom of the ladle as well as much faster fluxing action, quite contrary to the general fears and assumptions of the prior art.

I have treated approximately 1000 heats of steel of many grades with the composition of this invention within the nine months preceding this application by addition to the ladle both before and during tapping, as well as by injection after tapping, with desulfurization results averaging 35% to 45% reduction in sulfur, using 6 to 15 lbs of my composition per ton of steel. This is a uniquely important result, particularly in semi-killed and killed steels, especially those with low carbon levels.

This invention can perhaps best be understood by reference to the following examples.

EXAMPLE I

A series of five 235 ton basic oxygen heats of aluminum killed steel were treated with a composition according to this invention (identified as Mix I) containing 70% pulverized burnt lime, 15% fine mesh acid grade flurospar and 15% atomized metallic Al. The results appear in Table I.

Table I

| Heat | Tap Carbon | Weight of Mix I | Tap Sulfur | Final Sulfur | Sulfur Drop | Percent Desulfurization |
|---|---|---|---|---|---|---|
| A | .055% | 2,800 lbs. | .025% | .014% | .011% | 44% |
| B | .06% | 2,800 lbs. | .016% | .009% | .007% | 44% |
| C | .052% | 2,800 lbs. | .015% | .008% | .007% | 46% |
| D | .03% | 2,800 lbs. | .016% | .010% | .006% | 38% |

Table I-continued

| Heat | Tap Carbon | Weight of Mix I | Tap Sulfur | Final Sulfur | Sulfur Drop | Percent Desulfurization |
|---|---|---|---|---|---|---|
| E | .03% | 3,200 lbs. | .016% | .008% | .008% | 50% |

EXAMPLE II

Two 235 ton basic oxygen heats of aluminum killed steel were treated with a composition according to this invention (Identified as Mix II) containing 70% pulverized burnt lime, 20% fine mesh acid grade fluorspar and 10% atomized metallic Al. The results appear in Table II.

Table II

| Heat | Tap Carbon | Weight of Mix II | Tap Sulfur | Final Sulfur | Sulfur Drop | Percent Desulfurization |
|---|---|---|---|---|---|---|
| F | .14% | 2,800 lbs | .018% | .012% | .006% | 33% |
| G | .048% | 2,800 lbs | .018% | .009% | .009% | 50% |

EXAMPLE III

Three 330 tons open hearth heats of aluminum killed steel were treated with the same composition as in Example II. The results appear in Table III.

| Heat | Tap Carbon | Weight of Mix II | Tap Sulfur | Final Sulfur | Sulfur Drop | Percent Desulfurization |
|---|---|---|---|---|---|---|
| H | .07% | 4,000 lbs. | .018% | .014% | .004% | 22% |
| I | N.R.* | 4,000 lbs. | .016% | .010% | .006% | 38% |
| J | .09% | 4,000 lbs. | .019% | 0.13% | .006% | 32% |

*Not Reported

EXAMPLE IV

Five 200 ton BOP heats of aluminum killed steel were treated with a composition according to this invention (Identified as Mix III) containing 70% pulverized burnt lime, 25% fine mesh acid grade fluorspar and 5% atomized metallic Al. The results appear in Table IV.

| Heat | Tap Carbon | Weight of Mix III | Tap Sulfur | Final Sulfur | Sulfur Drop | Percent Desulfurization |
|---|---|---|---|---|---|---|
| K | .047% | 2,400 lbs. | .019% | .012% | .007% | 37% |
| L | .050% | 2,400 lbs. | .019% | .010% | .009% | 47% |
| M | .086% | 2,400 lbs. | .016% | .010% | .006% | 38% |
| N | N.R.* | 2,400 lbs. | .032% | .018% | .014% | 44% |
| O | N.R.* | 1,200 lbs. | .008% | .003% | .005% | 62.5% |

*Not Reported

It is apparent from the foregoing examples that the compostion and practice of this invention will effectively reduce the sulfur level in killed and semi-killed steels.

In the preceding specification, I have set out certain preferred embodiments and practices of my intention, however, it will be understood that this invention may be otherwise embodied within the scope of the following claims.

I claim:

1. A ladle desulfurization composition for desulfurizing molten steel consisting essentially of a mixture of particulate lime, particulate fluorspar and particulate metallic aluminum proportioned to provide deoxidation of the molten steel, with the resultant production of sufficient $Al_2O_3$ to combine with the fluorspar to provide a flux for CaO and desulfurization.

2. A ladle desulfurization composition for desulfurizing molten steel as claimed in claim 1 consisting essentially by weight of about 5% to about 35% metallic aluminum, about 10% to about 40% fluorspar, about 50% to 80% lime.

3. A ladle desulfurization composition as claimed in claim 2 wherein all ingredients are less than 35 mesh particle size.

4. A ladle desulfurization composition as claimed in claim 1 consisting essentially of about 5% to about 15% metallic aluminum, about 10% to about 25% fluorspar and about 60% to 75% lime.

5. A ladle desulfurization composition as claimed in claim 1 consisting essentially of about 15% metallic aluminum, about 15% fluorspar and about 70% lime.

6. A ladle desulfurization composition as claimed in claim 1 consisting essentially of about 10% metallic aluminum, about 20% fluorspar, and about 70% lime.

7. A ladle desulfurization composition as claimed in claim 1 consisting essentially of about 5% metallic aluminum, about 25% fluorspar and about 70% lime.

8. A method of ladle desulfurization of steel comprising the steps of:

(a) placing about 6 lbs. to 15 lbs. of a mixture of particulate metallic aluminum fluorspar and lime per ton of steel to be tapped into a ladle; and (b) tapping molten steel into said ladle and mixture to melt said mixture and form a desulfurizing slag.

* * * * *

UNITED STATES PATENT AND TRADEMARK OFFICE

CERTIFICATE OF CORRECTION

PATENT NO. : 4,142,887
DATED : March 6, 1979
INVENTOR(S) : Leon Luyckx

It is certified that error appears in the above-identified patent and that said Letters Patent are hereby corrected as shown below:

Column 2, line 54, "190 4" should read --#4--.

Column 3, line 19, --additional-- should be inserted after "requires".

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*